United States Patent [19]

Akers

[11] 3,975,184

[45] Aug. 17, 1976

[54] METHOD AND APPARATUS FOR PRODUCTION OF HIGH QUALITY POWDERS

[75] Inventor: Ronald R. Akers, Glenwood, Md.

[73] Assignee: Westinghouse Electric Corporation, Pittsburgh, Pa.

[22] Filed: July 8, 1974

[21] Appl. No.: 486,710

[52] U.S. Cl. ..... 75/.5 B; 13/11; 264/10; 425/6

[51] Int. Cl.[2] ..... B22D 23/08

[58] Field of Search ..... 75/.5 B, .5 BA, .5 BB, 75/.5 C; 264/10; 425/6; 13/9, 10, 11

[56] References Cited

UNITED STATES PATENTS 3,021,562 2/1962 Chisholm et al. ..... 75/.5 BB 3,721,511 3/1973 Schlienger ..... 264/10

*Primary Examiner*—W. Stallard

*Attorney, Agent, or Firm*—M. J. Moran

[57] ABSTRACT

An electric arc which is struck between an electrode and the surface of a pool of molten material rotates under the influence of a magnetic field to thereby free liquid particles from the surface of the pool. The particles produced are quenched in an adjacent inert atmosphere or solidified in a vacuum and become powder. This powder is then collected conveniently.

33 Claims, 10 Drawing Figures

PRODUCTIVITY OF Ti-6AL-4V POWDER AS A FUNCTION OF $\vec{J} \times \vec{B}$

METHOD AND APPARATUS FOR PRODUCTION OF HIGH QUALITY POWDERS

BACKGROUND OF THE INVENTION

This invention relates generally to methods and apparatus for producing high quality powder particles from molten material. The invention relates specifically to producing metallic powder untilizing the effects of an electric arc.

It is known that an electric arc furnace can be utilized for producing metallic powders. It is known to utilize an ingot of highly purified material such as titanium in an arc chamber or arc furnace in proximity to a graphite, carbon or refractory metal electrode such as tungsten for striking an arc. An arc is struck between the electrode and the ingot both of which are conveniently connected in circuit relationship with an external source of power. The ingot is rotated or spun such that the arc root resides on different portions of the ingot continuously. The arc melts the ingot locally and the spinning effect causes melted particles to be thrown outwardly away from the surface of the rotating ingot after which the particles are quickly solidified into powder. The prior art process is known in the art as the Rotating Electrode Process used under the trademark REP. This process is described on pages 433–437 of the book THE SUPERALLOYS published by John Wiley and Son, New York in 1972 and edited by Chester T. Sims and William C. Hogel. A number of problems and disadvantages are associated with the previously described process and apparatus. Since an ingot of high quality material is necessary initially, the process and apparatus of the prior art require two stages. The preliminary stage comprises casting the high quality ingot and then mounting it in a convenient manner in the chamber where it is to be utilized. This means that mechanical apparatus must be provided for rotating the ingot. This also means that the ingot must be machined to provide a well balanced mass for rotation for powder production. The second stage comprises powder production utilizing the rotating ingot and an electric arc in combination.

Another powder producing apparatus is described in U.S. Pat. No. 3,721,511 issued March 20, 1973 to M. P. Schlienger. In this case a molten pool of material is spun until centrifugal force causes molten material to leave the rotating crucible. A rotating nonconsumable electrode is utilized to heat the melt but not to significantly enter into the operation freeing of molten particles from the melt. Other U.S. patents which do not teach powder production but which do teach arc melting and which are in the name of the latter mentioned inventor are: U.S. Pat. Nos. 3,420,939 issued Jan. 7, 1969, 3,461,214 issued Aug. 12, 1969, 3,649,733 issued Mar. 14, 1972 and 3,651,239 issued Mar. 21, 1972.

In a process sometimes known as the "Centrifugal Shot Casting" process, a spinning melt or pool apparatus is utilized with a consumable electrode to produce powder.

The latter two powder producing apparatus have the disadvantage of utilizing a spinning melt and crucible requiring energy utilization therefor. In addition the arc does not significantly enter into the freeing of the liquid particles.

It would be advantageous if powder producing apparatus and process could be found where the production of an ingot as a preliminary step was not necessary. It would also be advantageous if a process and apparatus could be found where relatively low or medium quality feed stocks such as machine shop chips or scrap parts could be utilized directly in a powder producing process. It would also be advantageous if most of the energy of the process was utilized for producing powder rather than for producing heat for the formation of an initial ingot. It would be further advantageous if material which comes in contact with the molten particles was not reactive, so that relatively pure, high quality powders could be produced. It would also be advantageous if a non-consumable electrode, especially of the arc moving type, could be utilized as part of the novel combination of the apparatus. Such an electrode is described in U.S. Pat. No. 3,793,468 issued to R. R. Akers on Feb. 19, 1974. Another non-consumable electrode is described in U.S. Pat. No. 3,597,519 issued to G. A. Kemeny and R. R. Akers on Aug. 3, 1971. Both of the latter described patents are assigned to the same assignee as the present invention.

SUMMARY OF THE INVENTION

In accordance with the invention described and claimed in this application, an electrode, is disposed in a chamber for producing power. The chamber may comprise suitable metallic walls which may be water cooled in some embodiments. A crucible or similar means is provided in proximity to the electrode and the crucible is provided with molten material or solid feed stock which may range from low or medium quality machine shop chips or scrap to high quality material. The main electrode may supply the heat for melting or an auxiliary device may be provided which melts these materials to place them in a molten state thus forming a relatively shallow pool of molten material. The shallow pool of molten material is electrically connected in circuit relationship to one terminal of a suitable power supply. The previously described electrode is connected in circuit relationship to a power supply terminal of different voltage value. Consequently, an electric arc may be struck between the non-consumable electrode and the surface of the shallow pool of molten material. In some embodiments of the invention, a magnetic field generating means may be provided proximate the tip of the non-consumable electrode and/or proximate to the crucible and/or proximate a portion of the furnace wall. The magnetic field producing means, if an electromagnet, may be provided with electrical current of sufficient magnitude to produce magnetic field lines of flux in the gap or space between the electrode and the surface of the molten pool. The magnetic lines of flux may be made to have a strong component generally parallel to the bottom surface of the electrode and to the top surface of the pool. The electric arc may interact with the generally perpendicular magnetic lines of flux to cause the arc to move across the surface of the pool in a generally rotational manner. The plowing effect of the arc may cause particles to splash away from the surface of the molten pool. In addition, other phenomena such as arc spin, centrifugal force, arc pressure and JXB force (Lenz's law) may also significantly contribute to the overcoming of the surface tension of the pool of molten material to free droplets of molten material which may then be accelerated to or otherwise provided to a region outside of the area between the electrode and the pool. The particles may be quenched by a suitable atmosphere thus providing solid granules of high quality powder. The invention relates to producing powder without having to provide rotating mechanical motion to the ingot or it relates to using a water cooled non-consumable electrode either in conjunction with or not in conjunction with a rotating ingot.

BRIEF DESCRIPTION OF THE DRAWINGS

For a better understanding of the invention reference may be had to the preferred embodiments exemplary of the invention shown in the accompanying drawings, in which.

DESCRIPTION OF THE PREFERRED EMBODIMENTS

Figure 1A:
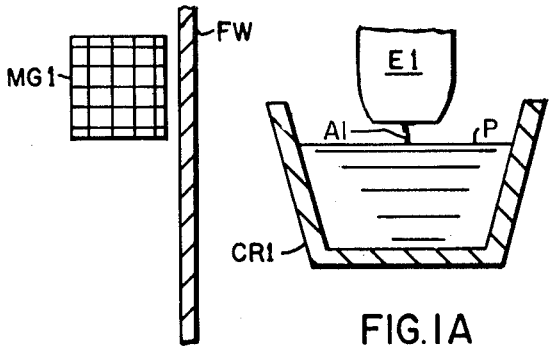
FIG. 1A shows a furnace section in elevation and in section with an electrode in proximity to a pool of molten material where a magnetic field producing means is dispersed adjacent to the furnace wall.
Figure 1B:
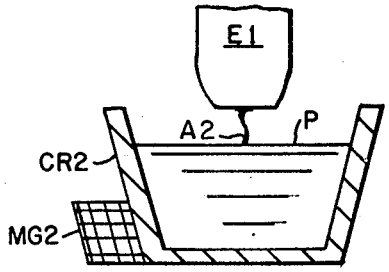
FIG. 1B shows a furnace section in elevation and in section with an electrode in proximity to a pool of molten material where a magnetic field producing means is disposed adjacent to the crucible in which the pool is disposed.
Figure 1C:
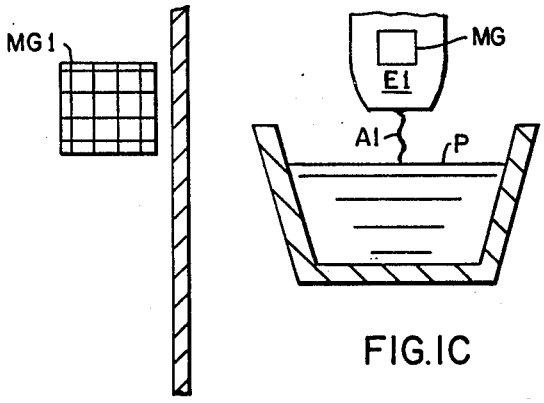
FIG. 1C shows an embodiment of the invention similar to that shown in FIG. 1A but with an additional magnetic field producing means in the electrode tip.
Figure 1:
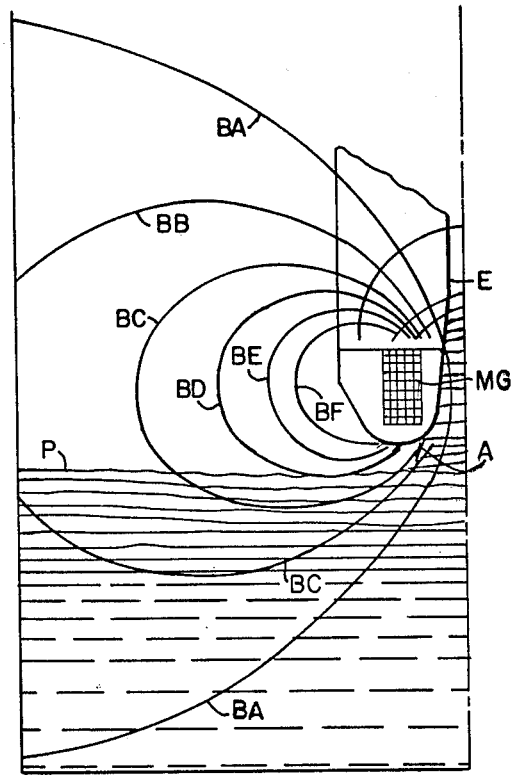
FIG. 1 shows an elevation of an electrode in section and broken away and having a magnetic field producing means therein, where the electrode is positioned above a pool of molten material and relatively close to the surface of the pool.

Referring now to the drawings, FIG. 1 shows a broken away portion of an electrode E which may be of the non-consumable type and which may have a magnetic field generating means MG disposed therein or thereby. For a better understanding of the operation of the electrode E, reference should be made to the previously described U.S. Pat. No. 3,793,468. The latter patent is directed to a non-consumable electrode such as sold and used under the trademark DURARC which is owned by the assignee of the present invention. It is to be understood that the electrode E of the present invention may be preferably used generally closer to the surface of the pool P than is shown in the latter patent. The molten pool P is contained within suitable containing means (not shown). An electric arc A is struck between the tip of the electrode E and the surface of the molten pool P. The magnetic field generating means MG, which may be an electromagnet, generates magnetic lines of flux which are generally designated BA through BF. The electric current in the arc A interacts with the magnetic lines of flux to cause movement of the arc A according to the well-known principle of Lenz's law, which is otherwise known as the Right-Hand Rule. The previously described motion which is imparted to the arc A is useful in the present invention for purposes which will be described hereinafter.

Prior to the discovery of this invention, it had generally been considered disadvantageous to generate splash or to throw off of particles from the surface of a melt of molten material by the action of an electric arc as it moved over the surface of that molten material. It is well known that the formation of solidified material on the face of an electrode or other furnace apparatus was considered detrimental to furnace operation. However, in conjunction with this invention, it has been discovered that a controlled release of liquid or molten particles from the surface of the molten pool or melt P is advantageous for the production of high quality, fine powders. It has been found, that under certain operating conditions, which involve the electrical current in the electric arc, the electrical current in the magnetic field producing means (if an electromagnet) or the magnetic field strength from any source, the spacing between the tip of the electrode and the surface of the pool, the atmosphere or environment which surrounds the region through which the molten particles travel, and the constituent feed stock material of the powder production apparatus, all either interacting or acting alone that an efficient, low cost, highly reliable powder producing apparatus, which produces powders of great purity can be made. It has also been found that the size of the powder particles produced by be exceedingly small under certain operating conditions. It is not critical to this invention to know why the interaction of the arc with the surface of the molten pool produces freed particles of molten material. However, it has been found that there may be at least four phenomena associated with the foregoing which may explain why molten particles are freed from the surface of a melt. The phenomena which follow are merely illustrative and not limiting. The first of these phenomena is arc pressure. Arc pressure is related to the intensity of the arc and results in a depression in the surface of the pool of molten material which occasionally causes the local surface tension of the pool to be overcome thus causing the release of or casting away of particles to the surrounding region. Arc pressure may cause particle production similar to the way particles of water are produced or splashed out of the surface of a pool of water when a stone is dropped onto that surface. A second phenomenon which has been recognized may be generally described as arc plowing. This is a term which refers to the movement or spinning of the arc around the axis of the electrode and through the melt in such a manner that the surface tension of the liquid or molten material is disturbed thus causing a spray to be thrown up in front of and to a lesser extent around the side of the moving arc. This may be likened in an illustrative manner to the kind of spray or particle displacement that the bow of a ship throws ahead of it as it moves through water. Still another phenomenon which is recognized and which is electromagnetic in nature, is the effect of the JXB force, otherwise known as the J cross B force. This force is related to Lenz's law which generally stands for the proposition that if electrical current flows in one direction and is made to interact with magnetic lines of force which exist perpendicular to the direction of the current flow, motion will occur which is perpendicular to the latter two directions or orientations. This is the force which may cause the arc to rotate or move along the surface of the electrode. In addition, some of the electrical current in the arc is concentrated immediately at the surface of the pool in a spherical volume. Magnetic lines of force also flow through the same region. Consequently, the molten material in this region is made to move in a direction perpendicular to the directions of the current and magnetic field lines in this region. This force can be made sufficiently large to overcome surface tension and cause particles to be thrown out of the surface of the pool. The last phenomenon is related to centrifugal force. The centrifugal force in this embodiment of the invention is a local force, that is, the force of the arc moving across the surface of the melt causes a displacement of molten particles from the surface of the melt due to the centrifugal mechanical force of the arc moving across the surface. The centrifugal force also provides a second function. The second function is the subsequent movement or acceleration of particles which have been freed previously from the surface of the melt for any reason. Consequently, particles which have been freed or displaced from the pool for any of the preceding prior named reasons or other reasons may be directed outwardly away from the arc due to the mechanical centrifugal force. One of the reasons this occurs is that the arc can be made to rotate around the surface of the electrode at very high speed. This causes local chamber gas in the vicinity of the arc to move or swirl at some speed related to the speed of the arc movement. Freed particles become caught up in the swirling gas and acquire sufficient mechanical energy to be spun off from the swirling gas outwardly forwardly and/or radially away from the region of the arc and the swirling gas. This may be thought of as a tornado effect. With regard to the movement of liquid or molten particles through an atmosphere, it has been found that there is a relationship between the atmospheric drag on the moving particle and the particle's surface tension. This relationship is related to the Weber number. This number is an indication of the likelihood of a molten or liquid particle subdividing due to interaction between the two previously described phenomena i.e., surface tension and drag. The Weber effect may occur close to the place where the particle is discharged or freed from the molten pool and it has the tendency to subdivide liquid particles into finer liquid particles. The Weber number or effect is also related to the speed of the liquid particle as it is thrown off or freed from the melt.

FIG. 1A shows a crucible CRI having a pool of molten material P disposed therein. An electrode E1 is disposed above the pool P and an arc A1 is shown between the electrode E1 and the pool P. There is shown a furnace wall FW along the outside of which is disposed a magnetic flux generating means MG1 which produces a magnetic field which interacts with the electrical current in the arc A1 to thereby cause the arc A1 to move or do other useful things.

FIG. 1B shows a furnace arrangement similar to that shown in FIG. 1A. However, in this case a magnetic field generating means MG2 is disposed at the side of or near the crucible CR2 which produces a magnetic field which interacts with the electrical current in the arc A2 to thereby cause the arc A2 to move or do other useful things.

FIG. 1C shows a furnace arrangement similar to that shown in FIG. 1A. However an electrode tip mounted magnetic field generating means MG such as shown in FIG. 1 is shown for interacting with the magnetic field producing means MG1 to thereby jointly produce a resultant magnetic field for interacting with the arc A1 to cause movement thereof or diffusion thereof or similar useful purposes.

Figure 2:
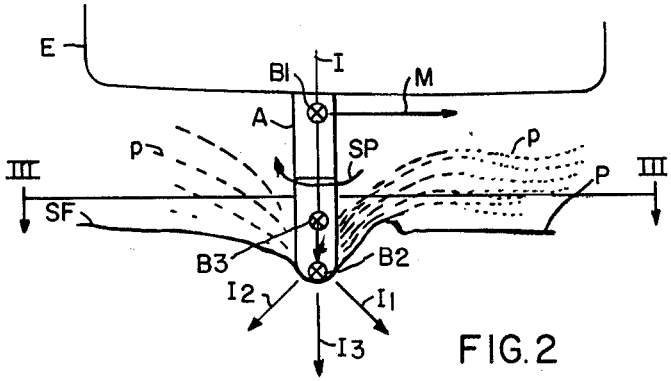
FIG. 2 shows a diagrammatic elevation of a portion of an electrode and molten pool similar to that shown in FIG. 1, but in the immediate vicinity of the arc.
Figure 3:
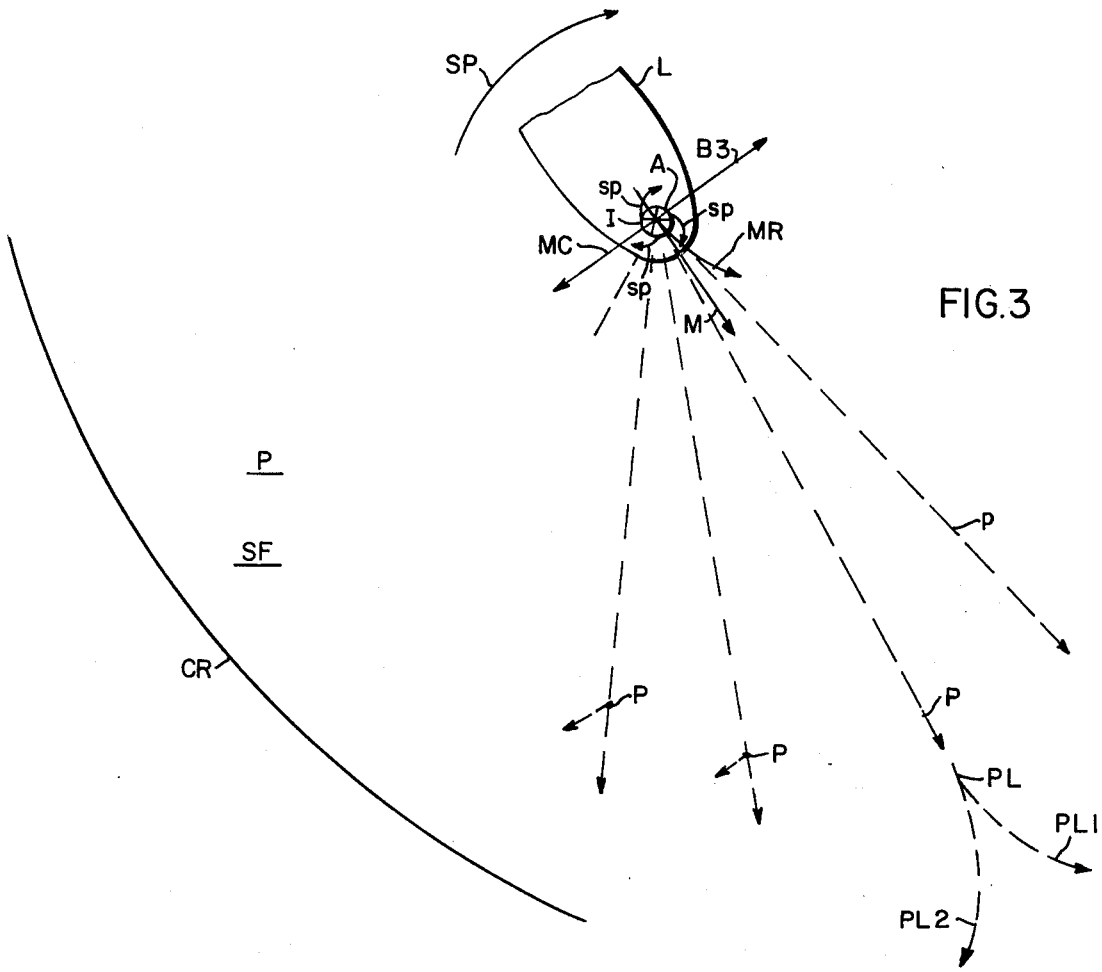
FIG. 3 shows a view through section III—III of FIG. 2.

By referring now to FIG. 2 and FIG. 3, a physical embodiment of the invention in diagrammatic form is shown. With respect to FIG. 2, the electrode E is shown and the pool P is shown. Struck between the electrode E and the pool P is the arc A. The arc A, though shown as a discrete cylinder for purposes of illustration, may be irregular, dynamic, may pulsate vertically and may at times become diffused depending upon the surrounding atmosphere, the current value and the value and disposition of the magnetic field line. There is shown flowing in the arc A electrical current I. In this case, the current I flows through the arc into the pool P where it then subdivides or diffuses. In FIG. 2, three illustrative subdivided current paths 11, 12 and 13 are shown. The component of spin SP may be thought of as being responsible for freeing all or some of the particles *p* from the pool P. This will be better illustrated in FIG. 3. It will be noted that the surface SF of the pool P is depressed in the region where the arc A strikes the pool P. This depression is related to the previously described arc pressure or arc intensity. This may be though of as being responsible for the freeing of some or all of the particles p from the pool P. There are shown three illustrative components of electromagnetic flux generally designated B1, B2 and B3. These components are shown in a direction transverse to the flow of electrical current I and into the plane of FIG. 2. As has been described previously with respect to Lenz's law, a component of motion is introduced to the arc because of the initiation of arc current I and flux B1, B2 and B3 which physically causes the arc to move in the direction M. The increment of flux density generally designated B2 is shown in the pool P below the surface SF thereof. This latter component of electromagnetic flux density interacts with the electric current I flowing immediately below the surface SF of the pool P to provide sufficient mechanical energy to the molten pool in this region to overcome the surface tension of the pool P to thus cause particles *p* to be freed and cast away from the surface SF of the pool P.

Referring now to FIG. 3, there is shown a view through section III—III of FIG. 2. The arc A is shown in cross-section with an X drawn therethrough to indicate that the flow of current during a particular instant of time is downward although that need not always be the case. The component of electromagnetic flux generally designated B3 is shown interacting with the arc A and attempting to cause movement of the arc A in the direction M. The direction M is tangential to the actual direction of arc movement MR because the component of flux density at any instant of time and at any plane near the surface SF of the pool M is generally radially oriented, thus causing the arc to move in a circumferential or circular path such as path MR. An illustrative localized region L on the surface SF of the pool P is shown. In this region the surface SF of the molten pool P may be thought of as generally moving at some high speed which is related to the speed of the arc A whereas outside of this region the surface SF of pool P does not move as rapidly. Region L may be known as a wake region. The movement of this increment of surface L of molten material causes centrifugal force to be exerted against particles contained within other adjacent parts of the surface SF of the melt P thus causing particles *p* to be freed from the surface and to move outwardly perhaps with a general component of direction MC. In addition, the spin particles sp are shown being spun away from the surface SF because of the spinning of the arc A about its axis. In general, particles *p* are shown being moved away from the arc A perhaps due to all, some, or none of the phenomena previously described. It is to be understood that the particles may in fact move in any direction away from the arc A but for purposes of illustration they are shown moving outward from the region of the arc A and generally in front of the arc A and in some instances to the side of the arc A in a radial direction. It can be seen that one illustrative particle *p* is shown to split at a point PL into subparticles PL1 and PL2. This is related to the previously described Weber number or effect. The net effect is to produce two or more particles of smaller volume and smaller surface area than the original liquid droplet or particle. These particles may then be quenched and solidified forming very fine powder. The partial outline of a vessel CR is shown for containing the molten pool of material P. Droplet division usually occurs close to the arc where the fluid droplet remains superheated above the fusion temperature so that solidification has not started.

Figure 4:
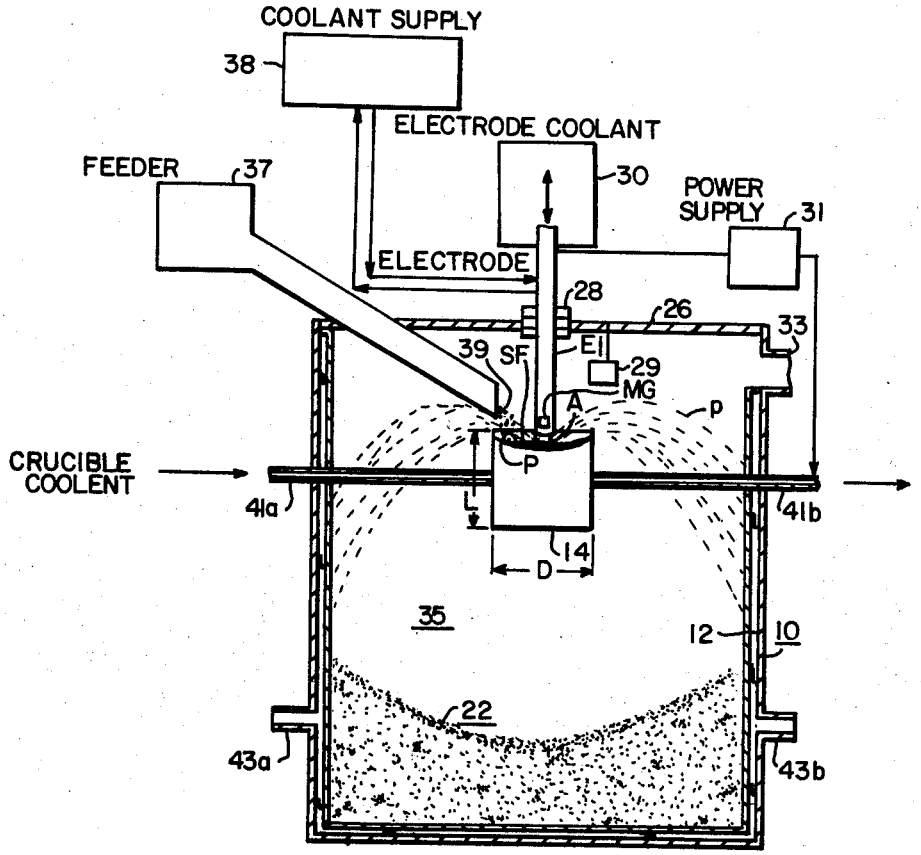
FIG. 4 shows an embodiment of the invention in side elevation partially in block diagram form and partially in secion.

Referring now to FIG. 4 an embodiment of the invention is shown utilizing a water cooled, non-consumable electrode E1. It should however be understood that a graphite electrode may also be utilized in some embodiments of the invention under certain circumstances. There is provided a chamber or furnace member 10 having a nonreactive inner wall 12, which may be for example a stainless steel inner wall. By nonreactive it is meant that the materials will not react with the commonly known powder products produced in the furnace. There is provided in the inner region of the chamber or vessel 10 a crucible 14, similar to the vessel CR of FIG. 3. In a preferred embodiment the crucible 14 is water cooled, electrically and thermally conductive and nonreactive at the interface with the molten material produced during powder production. Adjacent to the wall of the cooled crucible a skull or liner of hardened or semihardened molten material will usually form a barrier or interface which will prevent contamination. A water cooled copper crucible supplied with an electromagnetic field producing means is utilized in the preferred embodiment of the invention. Disposed above the crucible 14 is the non-consumable electrode E1. The electrode E1 may be supported in or by a member 30 which may be outside of the furnace or chamber 10. In some embodiments of the invention, the electrode E1 may be a rotating electrode and the apparatus 30 may be used generally to cause the electrode E1 to rotate, spin or move generally parallel to the surface SF of the pool P. In a preferred embodiment of the invention the length L to diameter D ratio of the crucible 14 is small to encourage maintenance of a shallow molten pool P. In other embodiments of the invention, the apparatus 30 is mechanically utilized to move the electrode E1 into and out of the chamber in a vertical manner for striking the arc, establishing the arc length, allowing for material to be fed and for installation, maintenance and the like. The electrode E1 may preferably be of the type generally sold and used under the trademark DURARC. There may be provided a suitable sealing means 28 in a region where the electrode E1 passes through the top cover 26 of the chamber 10. There may be also provided an auxiliary heating unit 29, shown in block diagram form in FIG. 4, the purpose of which will be described hereinafter. A suitable power supply means 31 is provided to be connected in electrical circuit relationship with the crucible 14 and the electrode E1 so that the previously described arc A may be struck therebetween. There is within the crucible 14 a pool P of liquid molten material such as metal. It is on the surface SF of this pool P that the arc A plays. There may be provided an input port 33 to the chamber 10 where a vacuum fixture may be attached for evacuating the chamber or maintaining a sub-atmospheric pressure or through which gas 35 may be introduced into the chamber 10. The chamber 10 may be of the sealed variety so that the gas 35 may not escape therefrom. The gas 35 may be pressurized in some embodiments. There may also be provided a feeder 37 with means for providing feed stock material 39 to the vicinity of the pool P. A coolant supply 38 may be present which supplies electrode coolant such as water to the electrode E1 with a suitable return. The crucible 14 may be externally cooled with a sufficient and suitable coolant such as water by way of input and output ducts 41*a* and 41*b*. In a similar manner, the chamber 10 may have hollow or ducted walls therein such that cooling paths 43*a* and 43*b* may be provided thereto for cooling the walls of the chamber 10. The particles p are shown being expelled or accelerated away from the surface SF of the melt P. In the region between the wall 12 and the surface SF of the pool P, the particles may be quenched by the gas 35 so that the particles strike the wall 12 as solid, semisolid or liquid particles, whereupon the particles may fall downwardly due to the force of gravity, cool, and collect, for example, at region 22. It is desirous to produce the particles *p* as efficiently as possible. An auxiliary heater 29 may be provided to heat the melt P to remove collar form around the edge of the melt P so that the particles *p* may have a generally unobstructed passage to the wall 12. In addition, the material supplied to the melt by the feeder 37 may, in some embodiments of the invention, be preheated and supplied to the crucible 14 as melted or molten material. In one embodiment of the invention, it is envisioned that machine shop chips, broken turbine blades or the like may be provided as scrap pieces by way of the feeder 37 or otherwise to the molten pool P where they may be melted by the heat of the pool P or otherwise. This allows for the quick and inexpensive recovery of scrap for the production of high quality powder. It has been found that the distance from the point where the particles are expelled from the surface SF of the pool P to the wall 12 should be sufficiently large to allow the particles to be quenched or cooled and solidified before they strike the wall. In some embodiments however, it is desirous to utilize the apparatus to produce splat or splatter material that is flat material with large relative surface area. This may be accomplished by allowing liquid particles to stike the wall.

It has also been found that it is advantageous to place the electrode E1 as close to the melt as possible because the magnetic flux density around the bottom of the electrode E1 is more intense closer to the tip surface of the electrode E1. This means that the rotation of arc spots in a space local to the surface SF of the melt P will be increased due to the relatively high magnetic flux density. The faster the arc A and the arc spots are accelerated, the more force will be applied to splash, throw or otherwise accelerate particles *p* away from the surface SF of the pool P. Arc spots are defined as those volumes of melt near the surface SF of the pool P where the arc root attaches at any instant of time. It has also been found that it is advantageous to have the pool P as shallow as possible. This maintains the volume of molten material low, consequently the energy of the arc which is applied to expel particles *p* from the surface of the pool P is utilized almost exclusively for that purpose and not for moving the entire volume and mass of the melt P. It has been found that it is not necessary to move the entire volume of the pool P to achieve powder production. To the contrary, if the melt P is of a large volume, the pool P may oscillate causing large waves and perturbances to exist within the pool P thus leading to less efficient production of powder. It has also been found to be advantageous to use decreased or lowered arc current I while concurrently using an increased component of magnetic field current. In this embodiment the magnetic field producing means is in the electrode E1. The component of arc current I is decreased to reduce the heating of the pool P which in turn causes a shallower pool P to be formed. Most of the energy of the arc A therefore is utilized in freeing particles *p* from the surface SF of the pool P. Since the electrical current flowing in the magnetic field generating apparatus or electromagnet MG is related to the amount of electromagnetic flux "B" produced, more flux B will be produced if the magnetic fluid is strengthened. The increase of magnetic field current has a compensating effect for the decrease of the arc current. Consequently, the force associated with the rotating arc A, namely the JXB force is maintained or enlarged or raised even though arc current I is lowered. The pool P may be kept shallow by supplying coolant material to the crucible 14 through the ducts 41*a* and 41*b*. It has been found that the pressure of the gas 35 within the chamber 10 affects the formation of powder particles. The effect may be twofold. In one instance, the pressure of the gas causes the arc A to be relatively narrow and dense causing high speed very forceful local pool surface agitation. In a second instance, the pressure is exerted against the molten particles *p* as they move through the quenching gas 35 consequently causing the particles to be solidified more quickly. It has also been found that it is advantageous to keep the particles as impurity-free as possible. As was described previously, it is advantageous in many instances to avoid having reactive agents or elements in the chamber or furnace. It is advantageous to provide a non-consumable electrode E1 constructed of generally copper alloy material as well as a copper crucible 14 and a stainless steel side wall 12 for the furnace 10. In another embodiment of the invention the electode E may also be rotatable.

The furnace 10 is adapted for the production of powders of titanium, zirconium, high temperature nickel-based superalloys, high temperature ferrous alloys and other materials. In the preferred emboidment, the side walls 12 of the furnace may be stainless steel to provide for a nonreactive surface. Also, it has been found advantageous in some instances to provide a gas 35 which is chemically reactive with some materials which may be found on scrap material for the purpose of removing these contamination materials from the scrap material. As an example, a hydrogen atmosphere may be utilized under certain circumstances to reduce the oxygen content of stainless steels. It may also be advantageous to provide a gas 35 to chemically react with the molten particle *p*. It is desirous in some embodiments of the invention to provide a plasma jet for the auxiliary heater 29.

The powders 22 produced from this furnace have many useful purposes. These powder particles may be essentially spherical in shape as in the case of powder or flat as in the case of splat. As such, they can be placed into molds or forms of intricate shapes and then sintered. The fact that the powders are finely divided and utilized in the manner previously described provides for a uniformity of blend of materials which may comprise two different kinds of powders and also provides for a good grain size in the finished piece because the grain size of the material in the finished piece will approximate the particle size of the powder that is used to make that piece. It has been found that a powder producing furnace 10 of the type described is ideal for producing powder sizes which range from 10 mesh, which is approximately 1.682 millimeters or 0.0625 inches, to 325 mesh which is approximately 0.044 millimeters or 0.0017 inches. It has also been found that it is advantageous to space the tip of the electrode E approximately one-half inch or less fromm the pool surface SF. In a powder producing operation as is shown in FIG. 4, it is desirous for the current of the arc A to be approximately 2 kiloamps. In a powder producing operation, the field current of an electromagnetic field producing means MG such as shown in FIG. 1 is approximately 1500 amperes.

Figure 5:
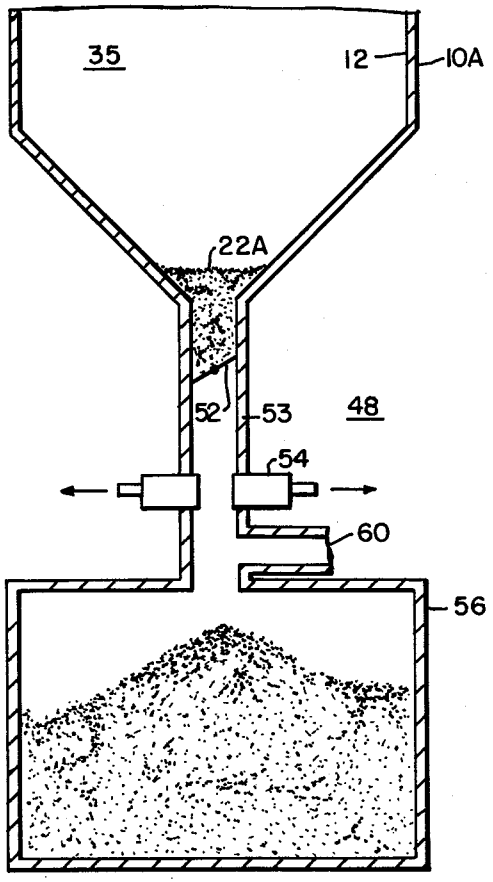
FIG. 5 shows a powder collecting apparatus which may be utilized with the chamber of FIG. 4.

Referring now to FIG. 5, a hopper or collection apparatus 48 is shown. The particle or powder collection apparatus 48 may be conveniently and suitably connected to the bottom of a furnace or chamber 10A similar to the furnace of chamber 10 of FIG. 4. The powders 22A, in this embodiment of the invention, are collected at the bottom of a conically-shaped hopper and are maintained in place by a movable valve arrangement 52. By opening the valve 52, the powders may move downwardly through a neck 53 which is cooled by cooling means 54, past a gas duct 60, into a large hopper or chamber 56 where the particles are collected. This provides an interface region between the gas pressurized furnace 10A where the gas 35 may be maintained and a suitable collection bin 56. It is to be understood that in an industrial production unit two valves may be desirable. One valve similar to 52 is used to stop the flow of power and a second sealing valve may be used to isolate the chamber 35 so that the collection chamber 56 can be rapidly removed or exchanged for an empty chamber to allow for the continuous production of powder.

Figure 6:
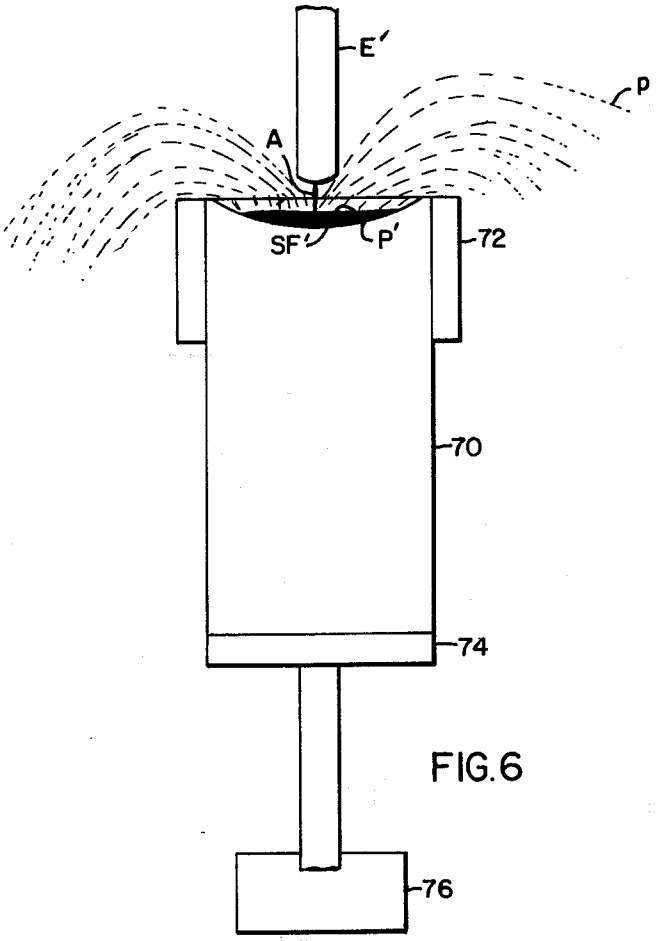
FIG. 6 shows another embodiment of the invention which may be utilized with the apparatus of FIG. 4.

Referring now to FIG. 6, another embodiment of the invention is shown in which a relatively pure ingot 70 is provided for producing molten particles *p*. In this embodiment the electrode E′ is non-consumable and is disposed in proximity to the ingot 70. The electrode E′ may be of the type described in previously mentioned U.S. Pat. No. 3,793,468 or may be under some circumstances of the type described in previously mentioned U.S. Pat. No. 3,597,519. In the later case the arc A must be made to move over the surface of the ingot 70. An electric arc A is struck in a convenient manner such as described with respect to FIG. 4 and a molten pool P′ is formed. The movement of the arc A around the base or tip of the electrode E and on the surface SF′ of the pool P′ causes a generation or production of molten particles *p*. Cooling means 72 are provided around the outer surface of the ingot 70 to provide sufficient cooling to keep the pool P′ as shallow as possible for reasons previously discussed. A raising means or platform 74 is provided for continuously feeding the ingot 70 upwardly towards the electrode E′ as the particle material p is discharged or thrown away from the molten pool P′. Suitable raising apparatus 76 is provided to drive the platform means 74. It is also to be understood that in some embodiments of the invention described in FIG. 6, that the ingot 70 may be made to rotate about a longitudinal axis through the center thereof. However in the latter embodiment the electrode E′ must be fluid cooled or non-consumable or have magnetic field generating means close by as shown in FIGS. 1 and 1A. In a like manner, as was described previously, the electrode E′ may be of the rotatable or rotating type.

Figure 7:
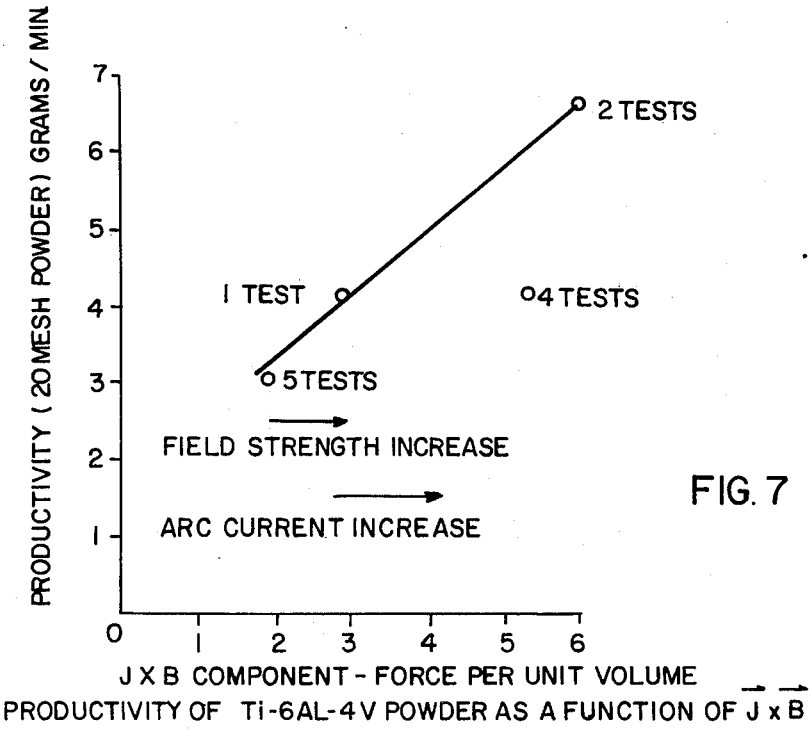
FIG. 7 shows a plot of powder production vs. JXB.

Referring now to FIG. 7 A plot of powder productively vs JXB is shown for a material known as Ti-6al-41. It will be noted that as arc current and magnetic field strength are increased either alone or together powder production increases.

It is to be understood with respect to the embodiments of the invention that all of the phenomena or parameters previously described need not be present at one time in all embodiments of the invention. As an example, the gap size need not be critical in one embodiment of the invention. In another embodiment of the invention, the pressure of the gas 35 is not critical. In another embodiment of the invention, the relationship between the arc current and the field producing current is not the critical factor. In still another embodiment of the invention, the pools P, or P′ as the case may be, need not necessarily be shallow. In each of the foregoing cases, efficient inexpensive production of powders is attainable merely by adjusting some or only one of the critical parameters. As an example, a relatively deep pool P of material may be used with a gas 35 of low pressure and relatively poor quenching capabilities provided the relationship between the arc current and the field current is sufficient to produce molten particles *p*. In another embodiment of the invention the distance between the bottom of the electrode and the top of the pool P may be very large but efficient particle production takes place if the gas is of sufficient pressure and the relationship between the arc current and the field current is as was described previously with respect to the figures of the invention. Of course, it is to be understood that in other embodiments of the invention, all of the critical parameters or relationships may be utilized and adjusted to their maximum to maximize power production. It is also to be understood that the auxiliary heating apparatus 29 is not always necessary and may be deleted in some embodiments. It is also to be understood that none of the values described for the critical parameters are limiting and that other values for gap size, arc current, etc. may be utilized. It is also to be understood that the feeder 37 is not limiting either as to its presence or as to the way in which it supplies materials to the crucible. It is also to be understood that the various electrodes may be of the non-consumable type or may be of the rotating non-consumable type or both as described. In such a case powder production may be enhanced because liquid molten particles freed from the pool may make contact with the electrode and be thrown out thereby. It is also to be understood that the various phenomena described with respect to how particles are caused to be freed from the surface of the pool are not limiting but are merely illustrative of ways in which particles may be freed from pools. It is also to be understood that a graphite electrode in a vacuum may be considered as non-consumable for purposes of this invention. It is also to be understood that the furnace chamber may enclose a vacuum rather than a gas 35 in some embodiments if that is desirable. It is also to be understood that in some embodiments the liquid particle may be allowed to purposely strike the side wall of the furnace to thereby form splat or splatter which is flattened material rather than spherical material.

The apparatus embodied in the teachings of this invention have many advantages. One advantage lies in the fact that powders can be produced rather inexpensively by using the motion between an electric arc on an electrode and the surface of a molten pool to cast liquid molten particles away from the pool to subsequently solidify before being collected as powder. Another advantage lies in the fact that no preliminary step of forming and machining an ingot is necessary in most embodiments. Another advantage lies in the fact that the feed stock material may be of relatively low-grade quality that is, the material may be simple machine shop chips or the like. Another advantage lies in the fact that most of the energy of the arc is utilized in causing particle production.

What is claimed is:

1. Powder producing apparatus comprising:

chamber means;

pool means disposed in said chamber means for containing a pool of molten material having a surface with associated surface tension;

electrode means disposed in said chamber means in spaced relationship with said surface of said pool, an electric arc of predetermined current value being struck between said electrode means and said surface of said pool of molten material, said pool means and said electrode means being energized at different electrical potentials to cause said electric arc to be struck and sustained; and arc moving means for causing movement of said arc on said surface of said pool, said surface tension of said pool of material being overcome by a predetermined force related to said arc to enhance the giving up of liquid particles from said pool in the region of said arc for subsequent solidification.

2. The combination as claimed in claim 1 wherein said electrode means is non-consumable.

3. The combination as claimed in claim 1, wherein said chamber means has an inner surface which is disposed at a predetermined distance from said region of said surface of said pool where said liquid particles are given up, said later distance being sufficient to allow liquid particles which move toward said inner surface to solidify as generally spherical particles before they intercept said inner surface so that said particles will not coalesce or adhere to said wall.

4. The combination as claimed in claim 1, wherein said chamber means has an inner surface which is disposed at a predetermined distance from said region of said surface of said pool where liquid particles are given up, said later distance not being sufficient to allow liquid particles which move toward said inner surface to solidify before they intercept said inner surface so that said particles will splatter as they contact said wall to thus form splat.

5. The combination as claimed in claim 1, comprising quench medium contained within said chamber means, said quench material interacting with said liquid particles to enhance the solidification thereof by quenching.

6. The combination as claimed in claim 1, comprising feed means for providing feed stock to said pool of molten material to be melted therein to provide said liquid particles.

7. The combination as claimed in claim 1, wherein said force is related to the centrifugal force of said arc column as it moves over the surface of said pool.

8. The combination as claimed in claim 1, wherein said chamber means is pressurized above atmospheric pressure.

9. The combination as claimed in claim 1, wherein said chamber means is substantially evacuated.

10. Powder producing apparatus comprising:

chamber means;

pool means disposed in said chamber means for containing a pool of molten material having a surface with associated surface tension;

non-consumable electrode means disposed in said chamber means in spaced relationship with said surface of said pool, an electric arc of predetermined current value being struck between said electrode means and said surface of said pool of molten material, said pool means and said electrode means being energized at different electrical potentials to cause said electric arc to be struck and sustained; and magnetic field generating arc moving means for causing movement of said arc on said surface of said pool, said surface tension of said pool of material being overcome by a predetermined force related to said arc to enhance the giving up of liquid particles from said pool for subsequent solidification.

11. The combination as claimed in claim 10 wherein said magnetic field generating means is disposed proximate to said electrode means to provide a component of magnetic flux density between said electrode means and said surface of said molten pool to interact with said current of said arc to cause said movement of said arc over said surface of said pool.

12. The combination as claimed in claim 11, wherein said magnetic field generating means has an energizing field current flowing therein, wherein the value of said component of said magnetic flux density is related to the value of said field current, said value of said field current relative to said value of said arc current being such as to cause said force to be exerted by said arc.

13. The combination as claimed in claim 12, wherein the distance between said electrode means and said surface of said molten pool is of a predetermined value to cause the portion of said arc at said surface of said molten pool to interact with a predetermined value of said flux density to cause said force to be provided.

14. Powder producing apparatus comprising:

chamber means;

pool means disposed in said chamber means for containing a pool of molten material of predetermined surface area, volume mass and surface tension;

electrode means disposed in said chamber means in spaced relationship with said surface of said pool, an electric arc of predetermined current value being struck between said electrode means and said surface of said pool of molten material, said pool means and said electrode means being energized at different electrical potentials to cause said electric arc to be struck and sustained; and arc moving means for causing movement of said arc on said surface of said pool, said surface tension of said pool of material being overcome by a predetermined force related to said arc which causes substantial movement of said surface of said pool in the region where said arc resides on said surface without causing substantial movement of the remainder of said mass of said pool to thereby optimize the mechanical energy provided by said arc to overcome said surface tension of said pool to enhance the giving up of liquid particles from said pool for subsequent solidification.

15. The combination as claimed in claim 14, wherein said predetermined volume and mass of said pool is substantially determined by the depth of said pool.

16. The combination as claimed in claim 15, wherein said depth is generally one half inch or less at the deepest portion of said pool portion.

17. Powder producing apparatus, comprising:

non-consumable electrode means; and a generally vertically oriented ingot means disposed in spaced relationship with said non-consumable electrode means, an electric arc of predetermined current value being struck between said electrode means and a surface of said ingot means to form a pool of molten material at the top of said ingot means, said ingot means and said non-consumable electrode means being energized at different electrical potential to cause said electric arc to be struck and sustained therebetween, arc moving means provided to move said arc on the surface of said pool, the surface tension of said pool being overcome by a predetermined force related to said arc, said arc thus causing molten particles to be given up by said pool of said ingot means in the region of said arc which particles subsequently solidify as powder particles.

18. The combination as claimed in claim 17, wherein said non-consumable electrode means is fluid cooled.

19. Powder producing apparatus, comprising:

generally nonrotating ingot means;

electrode means disposed in spaced relationship with a surface of said ingot means, an electric arc of predetermined electric current value being struck between said surface of said ingot means and said electrode means, said ingot means and said electrode means being energized at different electrical potentials to cause said electric arc to be struck and sustained; and arc moving means for causing movement of said arc on said surface of said ingot means to thus cause molten particles to be given by said ingot means which particles solidify as powder particles.

20. Powder producing apparatus comprising:

chamber means;

pool means disposed in said chamber means for containing a pool of molten material having a surface with associated surface tension;

electrode means disposed in said chamber means in spaced relationship with said surface of said pool, an electric arc of predetermined current value being struck between said electrode means and said surface of said pool of molten material, said pool means and said electrode means being energized at different electrical potentials to cause said electric arc to be struck and sustained; and arc moving means for causing movement of said arc on said surface of said pool, said surface tension of said pool of material being overcome by a predetermined force related to arc column pressure against the surface of said pool to enhance the giving up of liquid particles from said pool for subsequent solidification.

21. Powder producing apparatus comprising:

chamber means;

pool means disposed in said chamber means for containing a pool of molten material having a surface with associated surface tension;

electrode means disposed in said chamber means in spaced relationship with said surface of said pool, an electric arc of predetermined current value being struck between said electrode means and said surface of said pool of molten material, said pool means and said electrode means being energized at different electrical potentials to cause said electric arc to be struck and sustained; and arc moving means for causing movement of said arc on said surface of said pool, said surface tension of said pool of material being overcome by a predetermined force related to the spin of the arc column to enhance the giving up of liquid particles from said pool for subsequent solidification.

22. Powder producing apparatus comprising:

chamber means;

pool means disposed in said chamber means for containing a pool of molten material having a surface with associated surface tension;

electrode means disposed in said chamber means in spaced relationship with said surface of said pool, an electric arc of predetermined current value being struck between said electrode means and said surface of said pool of molten material, said pool means and said electrode means being energized at different electrical potentials to cause said electric arc to be struck and sustained; and arc moving means for causing movement of said arc on said surface of said pool, said surface tension of said pool of material being overcome by a predetermined force related to the arc column plowing through an upper region of the volume of said pool to enhance the giving up of liquid particles from said pool for subsequent solidification.

23. Powder producing apparatus comprising:

chamber means;

pool means disposed in said chamber means for containing a pool of molten material having a surface with associated surface tension;

rotatable electrode means disposed in said chamber means in spaced relationship with said surface of said pool, an electric arc of predetermined current value being struck between said electrode means and said surface of said pool of molten material, said pool means and said electrode means being energized at different electrical potentials to cause said electric arc to be struck and sustained; and arc moving means for causing movement of said arc on said surface of said pool, said surface tension of said pool of material being overcome by a predetermined force related to said arc to enhance the giving up of liquid particles from said pool for subsequent solidification.

24. Powder producing apparatus comprising:

chamber means containing a chemically reactive medium;

pool means disposed in said chamber means for containing a pool of molten material having a surface with associated surface tension;

electrode means disposed in said chamber means in spaced relationship with said surface of said pool, an electric arc of predetermined current value being struck between said electrode means and said surface of said pool of molten material, said pool means and said electrode means being energized at different electrical potentials to cause said electric arc to be struck and sustained; and arc moving means for causing movement of said arc on said surface of said pool, said surface tension of said pool of material being overcome by a predetermined force related to said arc to enhance the giving up of liquid particles from said pool for subsequent solidification, said chemically reactive medium chemically reacting with said liquid particles to tend to purify the particles.

25. The combination as claimed in claim 24, wherein said medium comprises a gas.

26. A method for producing powder from a pool of molten material in a chamber in which an electrode is present, including the steps of:

providing an electric arc having a predetermined force associated therewith between the surface of said pool and said electrode to overcome the surface tension of said pool to enhance the giving up of liquid particles from said pool in the region where said arc impinges upon said surface;

solidifying said liquid particles into powder particles; and providing lines of magnetic flux having a component generally perpendicular to the electric current of said arc to thus move said arc relative to said surface of said pool to thus provide a component of said predetermined force.

27. A method for producing powder from a pool of molten material in a chamber in which an electrode is present, including the steps of:

providing an electric arc having a predetermined force associated therewith between the surface of said pool and said electrode to overcome the surface tension of said pool to enhance the giving up of liquid particles from said pool in the region where said arc impinges upon said surface;

solidifying said liquid particles into powder particles; and introducing a medium into said chamber for chemically reacting with feed stock materials which are supplied to said pool for melting.

28. A method for producing powder from a pool of molten material in a chamber in which an electrode is present, including the steps of:

providing an electric arc having a predetermined force associated therewith between the surface of said pool and said electrode to overcome the surface tension of said pool to enhance the giving up of liquid particles from said pool in the region where said arc impinges upon said surface;

solidifying said liquid particles into powder particles; and introducing a medium into said chamber to chemically react with said liquid particles.

29. A method for producing powder from a pool of molten material in a chamber in which an electrode is present, including the steps of:

providing an electric arc which has a predetermined force associated therewith between the surface of said pool and said electrode to overcome the surface tension of said pool to thus enhance the giving up of liquid particles from said pool in the region where said arc impinges upon said surface; and;

solidifying said liquid particles into powder particles.

30. The method of claim 29 including the step of moving said arc relative to said surface of said pool to thus provide a component of said predetermined force.

31. The method of claim 29 including the step of providing quenching medium to quench said liquid particles to cause them to solidify as powder.

32. The method of claim 31 wherein said particles are spherical in shape.

33. The method of claim 29 wherein said particles are spherical in shape.

* * * * *